US006917690B2

(12) United States Patent
Stiles

(10) Patent No.: US 6,917,690 B2
(45) Date of Patent: Jul. 12, 2005

(54) ELECTROMAGNETIC TRANSDUCER HAVING MULTIPLE MAGNETIC AIR GAPS WHOSE MAGNETIC FLUX IS IN A SAME DIRECTION

(75) Inventor: Enrique M. Stiles, Imperial Beach, CA (US)

(73) Assignee: STEP Technologies, Inc., Minneapolis, MN (US)

( * ) Notice: Subject to any disclaimer, the term of this patent is extended or adjusted under 35 U.S.C. 154(b) by 0 days.

(21) Appl. No.: 10/936,973

(22) Filed: Sep. 9, 2004

(65) Prior Publication Data

US 2005/0031154 A1 Feb. 10, 2005

Related U.S. Application Data

(63) Continuation of application No. 10/289,109, filed on Nov. 5, 2002.

(51) Int. Cl.[7] ..... H04R 25/00

(52) U.S. Cl. ..... 381/412; 381/414; 381/421

(58) Field of Search ..... 381/96, 400, 401, 381/402, 412, 413, 414, 416, 419, 420, 421, 422

(56) References Cited

U.S. PATENT DOCUMENTS

| | | | |
|---|---|---|---|
| 4,783,824 | A | 11/1988 | Kobayashi |
| 5,740,265 | A | 4/1998 | Shirakawa |
| 2003/0133587 | A1 | 7/2003 | Hyre et al. |
| 2003/0152246 | A1 | 8/2003 | Tanabe |

*Primary Examiner*—Curtis Kuntz
*Assistant Examiner*—Brian Ensey
(74) *Attorney, Agent, or Firm*—Richard Calderwood

(57) ABSTRACT

An electromagnetic transducer such as an audio speaker exhibiting highly linear performance over a greatly extended excursion. The motor structure includes a stack of two or more magnet and plate pairs, with the magnets polarized in the same orientation such that the magnetic flux flows in the same direction over all of the magnetic air gaps. The voice coil is handed off from gap to gap with a configuration providing a substantially constant BL over an end-to-end distance at least as large as the thickness of one plate plus twice the thickness of one magnet.

31 Claims, 11 Drawing Sheets

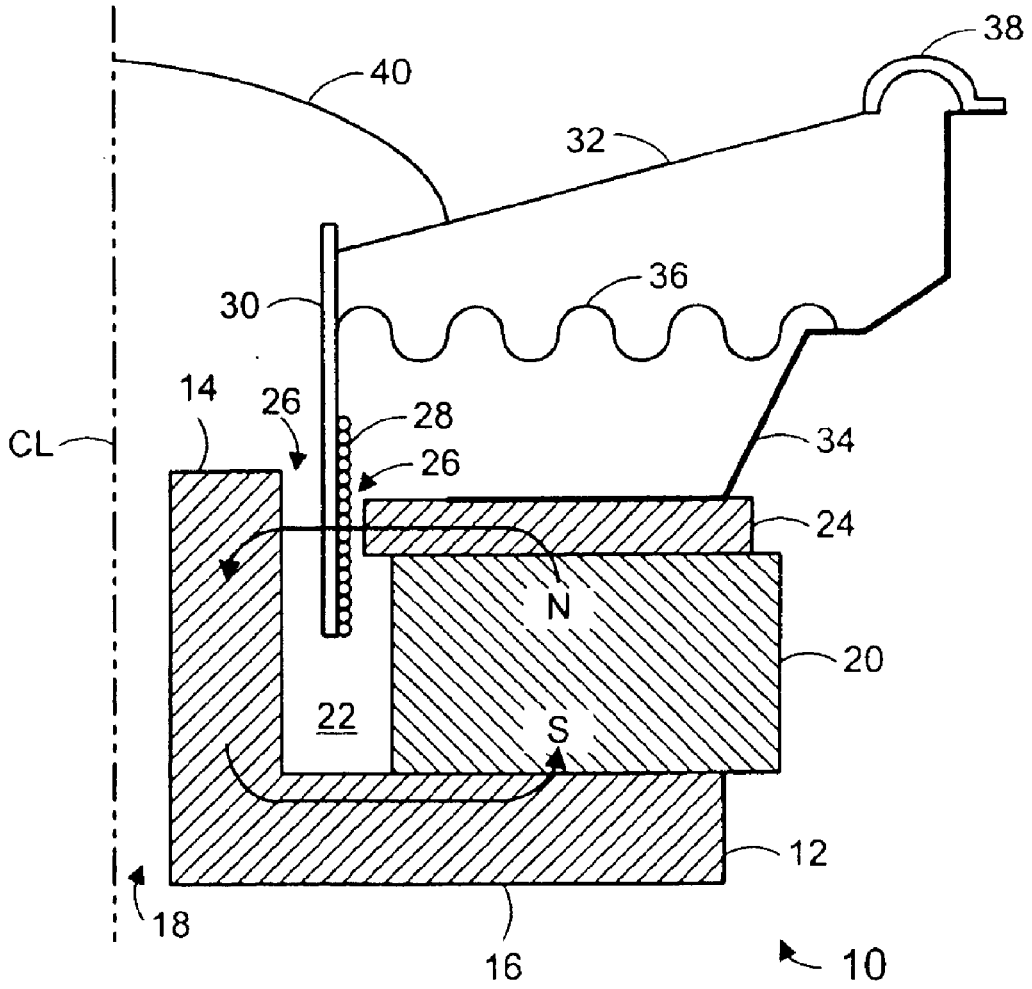
Fig. 1 - prior art

110

120

ELECTROMAGNETIC TRANSDUCER HAVING MULTIPLE MAGNETIC AIR GAPS WHOSE MAGNETIC FLUX IS IN A SAME DIRECTION

RELATED APPLICATION

This application is a continuation of co-pending application Ser. No. 10/289,109 entitled "Push-Push Multiple Magnetic Air Gap Transducer" filed Nov. 5, 2002 by this inventor.

BACKGROUND OF THE INVENTION

1. Technical Field of the Invention

This invention relates generally to electromagnetic transducers such as audio speakers, and more specifically to a multiple magnetic air gap geometry for such.

2. Background Art

Speakers are shown in cross-section in this document. Because speakers are generally cylindrically or rotationally symmetrical about an axis line or center line, only one side of any given speaker is shown, but the skilled reader will readily appreciate the three-dimensional structure which is thus represented. The reader will appreciate, however, that the invention is not limited to such axially symmetric implementations.

FIG. 1 illustrates a conventional audio speaker 10 such as is known in the prior art, shown as symmetrical about a center line CL. The speaker includes a magnetically conductive pole plate 12 which includes a pole 14 which may be either coupled to or integral with the base 16 of the pole plate, as shown. The pole may include an axial hole 18 for permitting airflow to cool the motor structure and depressurize the diaphragm assembly. A ring-shaped permanent magnet 20 surrounds the pole, with a cavity 22 between them. A magnetically conductive top plate 24 surrounds the pole, with a magnetic air gap 26 between them. Typically, the magnetic air gap will be smaller than the cavity. The pole plate, magnet, and top plate may collectively be termed a magnet assembly or a motor structure. The heavy black arrows denote exemplary directions of flux flow, throughout this document; the skilled reader will readily appreciate that the magnets may be reversed, and the flux will flow the opposite direction, and the transducer will operate correctly, especially when provided with an inverse phase electrical input signal.

An electrically conductive voice coil 28 is rigidly attached to a cylindrical bobbin or voice coil former 30. The voice coil is suspended within the magnetic air gap to provide mechanical force to a diaphragm 32 which is coupled to the bobbin. When an alternating current is passed through the voice coil, the voice coil moves up and down in the air gap along the axis of the speaker, causing the diaphragm to generate sound waves.

A frame 34 is coupled to the magnet assembly. There are two suspension components. A damper or spider 36 is coupled to the bobbin and the frame, and a surround 38 is coupled to the diaphragm and the frame. These two suspension components serve to keep the bobbin and diaphragm centered and aligned with respect to the pole, while allowing axial movement. A dust cap 40 seals the assembly and protects against infiltration of dust particles and other stray materials which might contaminate the magnetic air gap and thereby interfere with the operation or quality of the speaker.

When, as shown, the voice coil is taller (along the axis) than the magnetic air gap, the speaker is said to have an "overhung" geometry. If, on the other hand, the voice coil were shorter than the magnetic air gap, the speaker would be "underhung".

If the voice coil moves so far that there exists a different number of voice coil turns within the air gap (i.e. an overhung voice coil has moved so far that one end of it has entered the air gap, or an underhung voice coil has moved so far that one end of it has left the air gap), the speaker begins to exhibit nonlinear characteristics, and the sound quality is distorted or changed. This is especially problematic when playing low frequency sounds at high volume, which require maximum voice coil travel.

The common approach to solving this problem has been to use highly overhung or highly underhung geometries to achieve a high degree of linear voice coil travel. These approaches have inherent limitations, however. The highly overhung motor requires increasingly longer coils, which in turn increases the total moving mass of the diaphragm assembly. At some point, this ever-increasing mass becomes so great that the inherent mechanical design limits are reached, which prevents any further controllable increase in excursion. At the same time, increasing the voice coil mass with no resultant increase in utilized magnetic flux will reduce the overall efficiency of the transducer. Efficiency is proportional to BL squared, and inversely proportional to mass squared. In the highly underhung geometry, other practical limits are reached because of the relative increase in magnet area required to maintain a constant B across the magnetic gap height in order to achieve higher linear excursions without sacrificing efficiency. Unfortunately, this increase in available magnetic flux, B, does not result in an increase in BL, and therefore the transducer's efficiency also does not increase.

One hybrid approach has been to provide the bobbin with two tandem voice coils which travel in two respective magnetic air gaps, such as is taught in U.S. Pat. No. 4,783,824 to Kobayashi and U.S. Pat. No. 5,740,265 to Shirakawa. These are both "push-pull" geometries, in which the magnetic flux over the top magnetic air gap travels in the opposite direction as the flux over the bottom magnetic air gap; this requires that the two voice coils be wound in opposite directions, and it requires twice the total voice coil length and a longer bobbin without increasing the total linear excursion, all of which add manufacturing cost with minimal benefit. Kobayashi further teaches that the voice coils may be wound in the same direction if the currents through them are of opposite phases. Unfortunately, this requires each voice coil to have its own, dedicated pair of electrical inputs, which further increase the complexity and cost of the transducer.

In the prior art overhung speakers, 100% of the magnetic air gap is always active during linear operation. In the prior art underhung speakers, 100% of the voice coil windings are always active during linear operation.

Speakers may generally be classified as having an external magnet geometry (in which ring magnets surround a pole plate) or an internal magnet geometry (in which a cup contains magnets). Pole plates and cups may collectively be termed magnetic return path members or yokes, as they serve as the return path for magnetic flux which has crossed over the magnetic air gap.

Materials may be classified as either magnetic materials or non-magnetic materials. Non-magnetic materials may also be termed non magnetically conductive materials; aluminum and chalk are examples of non-magnetic materials. Magnetic materials are classified as hard magnetic materials and soft magnetic materials. Hard magnetic materials are also called permanent magnets, and generate magnetic flux fields without outside causation. Soft magnetic materials are those which, although not permanent magnets, will themselves become magnetized and generate flux in response to their being placed in a magnetic field. Soft magnetic materials include the ferrous metals such as steel and iron.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

FIG. 1 shows, in cross-section, a conventional speaker geometry according to the prior art.

DETAILED DESCRIPTION

The invention may be utilized in a variety of magnetic transducer applications, including but not limited to audio speakers, microphones, mechanical position sensors, actuators (which can be linear motors), and the like. For the sake of convenience, the invention will be described with reference to audio speaker embodiments, but this should be considered illustrative and not limiting. The invention may prove especially useful in high ("large") excursion applications such as subwoofer speakers, but, again, this should not be considered limiting.

This invention permits the simultaneous utilization of less than 100% of the magnetic air gap and less than 100% of the voice coil windings. For example, this invention allows optimum linear excursion to be achieved with the simultaneous utilization of 50% of the voice coil windings and 33% of the magnetic gap, or as another example, 66% of the magnetic gap and 33% of the voice coil windings could be obtained. A multitude of ratios are possible. This allows the designer to achieve a desired balance between, or combination of: high frequency extension, low frequency extension and enclosure volume, efficiency, linear excursion, cost, power handling, and size of the motor structure. The designer can now achieve a much broader range of combinations than were previously attainable.

Figure 2A:
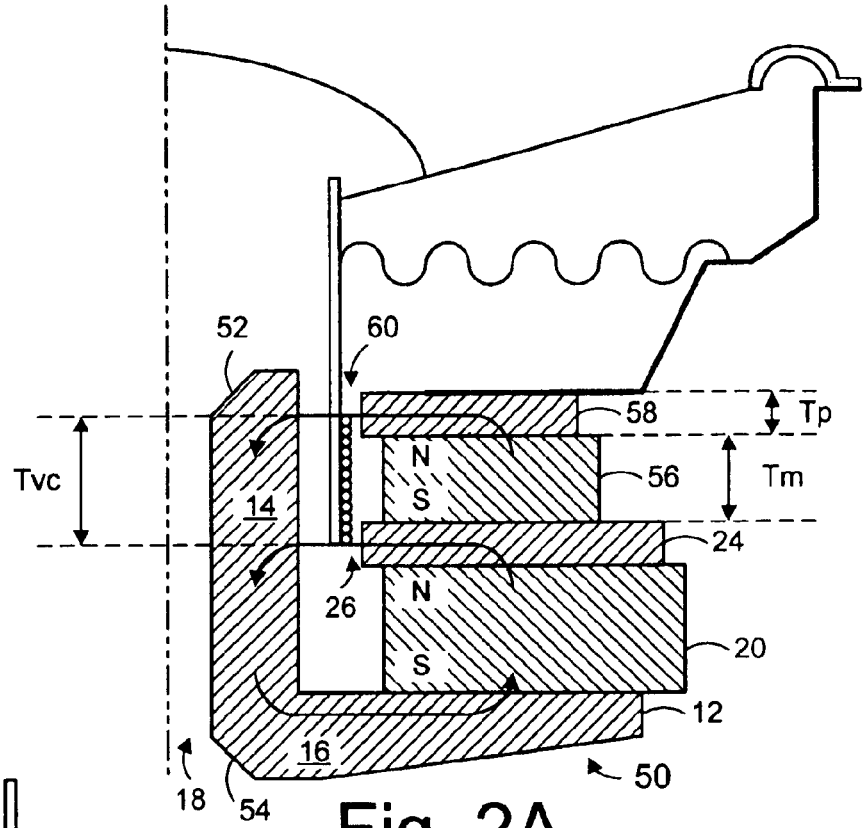
FIGS. 2A–C show, in cross-section, one embodiment of a speaker geometry according to this invention, having one voice coil and having two air gaps over which the magnetic flux is in the same direction.

FIG. 2A illustrates one embodiment of a speaker 50 according to this invention. The speaker includes a pole plate 12 including a back plate 16 and a pole piece 14 which can be either integral with or coupled to the back plate. In some embodiments, there may be a hole 18 extending through the length of the pole piece to permit air flow in response to the bellows action of the speaker. In some embodiments, it may be advantageous to adapt this hole with beveled ends 52, 54, for improved aerodynamic performance with less turbulence, allowing the use of a smaller hole or vent without causing too much distortion. If the vent is made too large, the magnetic efficiency is reduced, because of the reduced quantity of steel in the pole, which in turn could lead to magnetic saturation of the steel.

The magnet assembly includes a first permanent magnet 20, first plate 24, and first magnetic air gap 26 as in the prior art. The invention further includes a magnetic material member 56 which may, in some embodiments, be a second permanent magnet. Unlike in the prior art dual gap speakers, the magnetic material member is oriented with its flux in the same direction as the first magnet, or, in other words, such that the first magnet 20 and the magnetic material member 56 have opposite poles facing each other. The speaker further includes a second plate 58 which defines a second magnetic air gap 60.

The frame and the diaphragm assembly including the bobbin or tube, diaphragm, spider, surround, and dust cover may be substantially as known in the prior art. The voice coil, first plate, second magnet, and second plate may advantageously be sized such that the voice coil extends from the center of one plate to the center of the other plate. The voice coil may advantageously have a height Tvc which is substantially equal to the height Tm of the second magnet plus the height Tp of the second plate (which in most instances should be the same height as the first plate so the two air gaps are of equal height). In order to travel into a nonlinear response region, the voice coil would have to travel so far as to have its bottom end enter the upper second air gap, or its top end enter the lower first air gap. This gives the voice coil a peak-to-peak linear travel equal to the height (thickness) Tp of the upper top plate plus twice the height Tm of the space between the magnetic air gaps. In an optimized configuration, the two plates are of equal thickness, and the second magnet 56 should be at least as thick as either of the plates.

The relative sizes of the magnets, plates, pole plate, and pole piece can be determined according to the specific requirements of a particular application, and are well within the abilities of ordinary skilled speaker designers, once armed with the teachings of this patent. For example, it may often be the case that the lower magnet will need to be larger (or, more to the point, more powerful) than the upper magnet, in order to have equal flux through the two air gaps, because the lower plate, between the magnets, will shunt some percentage of the lower magnet's flux directly into the upper magnet rather than through the first air gap.

Figure 2B:
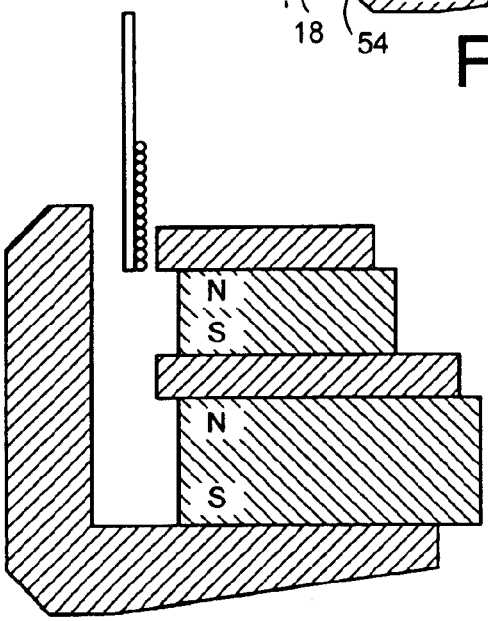
Figure 2C:
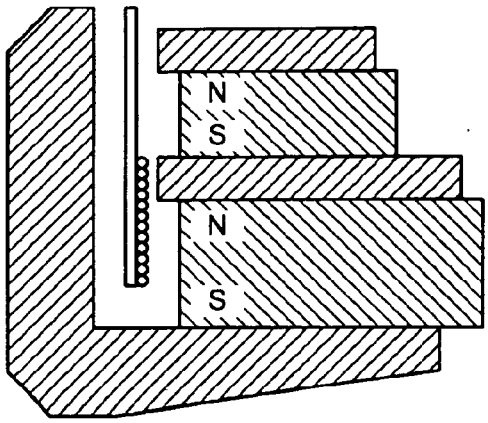

FIGS. 2B and 2C illustrate the embodiment of FIG. 2A with the voice coil at the points of maximum extension and retraction, respectively, in the region of linear excursion (Xmax). The reader should note that in all three FIGS. 2A–C, there is an equivalent of one magnetic air gap active (100% of the top magnetic air gap in FIG. 2B, 50% of each of the two magnetic air gaps in FIG. 2A, and 100% of the bottom magnetic air gap in FIG. 2C), and a total of one magnetic air gap's height of voice coil windings active. At any given point in the linear excursion realm, 50% of the total available magnetic air gap is active, with a corresponding length of voice coil, which is equal to Tvc minus Tm.

Figure 3A:
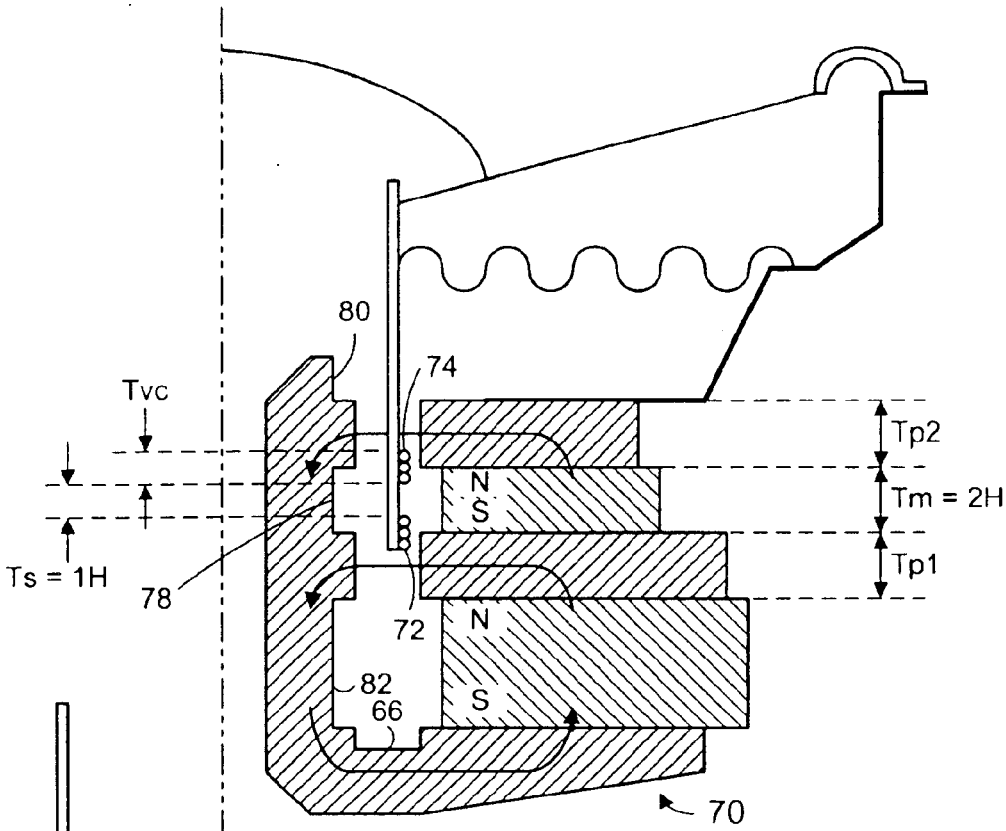
FIGS. 3A–C show, in cross-section, a second embodiment of a speaker, having two same direction magnetic flux air gaps and two tandem voice coils.

FIG. 3A illustrates a second embodiment of a speaker geometry 70 according to this invention, which is similar to the first embodiment except that it includes two voice coils 72, 74. Ideally, the two voice coils should be of the same height, and the distance from the center of one to the center of the other should equal the distance between the two air gaps (or, in other words, the thickness of the magnetic material member which is between their respective plates). In the optimum configuration with optimized linearity, the space between the two plates and each of the two plates should be of equal thickness, and this thickness should be the same as the height, Tvc, of one of the voice coils plus the space, Ts, between the voice coils, so that when, for example, the top voice coil is just beginning to exit the top of the top magnetic air gap during extension, the bottom voice coil will be just beginning to enter the top magnetic air gap.

Figure 3B:
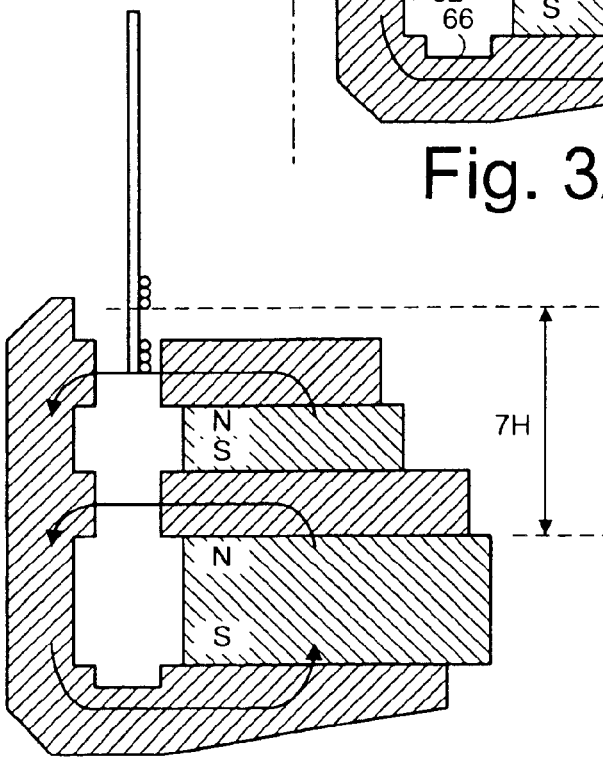
Figure 3C:
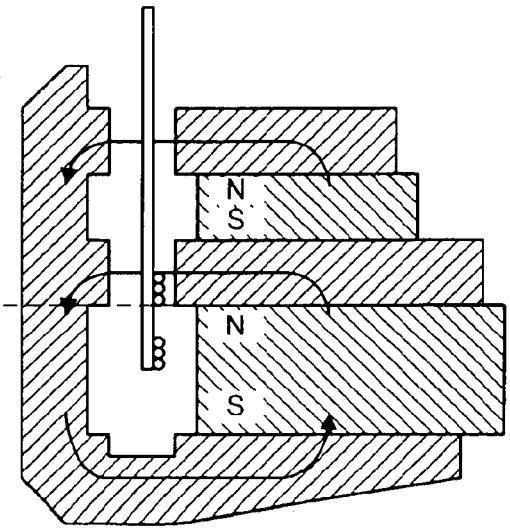

FIGS. 3A–C illustrate one very optimized embodiment, in which the height Tvc of each voice coil is a distance H, the height Tp1, Tp2 of each magnetic air gap is a distance 2H, and the distance Tm between the magnetic air gaps is 2H. Note that Ts=H=Tvc. This geometry gives a linear peak-to-peak excursion of 7H; at one extreme, the top edge of the bottom voice coil is even with the top of the top magnetic air gap, and at the other extreme, the bottom edge of the top voice coil is even with the bottom of the bottom magnetic air gap.

In one embodiment, the voice coils are wound in the same direction, and the electrical signal is applied to them in the same polarity. In another embodiment, the voice coils are wound in opposite directions, and they receive opposite polarity electrical signals.

Optionally, the pole plate may be adapted with a groove 66 into which the voice coil bobbin may extend at its maximum downward excursion, preventing the bobbin from striking the pole plate, which would grossly distort the sound and possibly damage the bobbin or voice coil and/or other components. This is taught in U.S. Pat. No. 5,715,324 to Tanabe et al.

In one mode, the pole piece may be adapted with a groove 78 substantially opposite the spacer or magnet between the air gaps, a groove 80 above the upper magnetic air gap, and a groove 82 below the lower magnetic air gap, to further improve linearity by concentrating more of the flux into the air gaps and creating symmetrical fringing fields above and below the edges of each air gap.

The reader should note that, in all three FIGS. 3A–C, there are 50% of the total available voice coil windings active in magnetic air gap(s), and 25% of the total available magnetic air gap is being used, during linear operation of the transducer.

Figure 4:
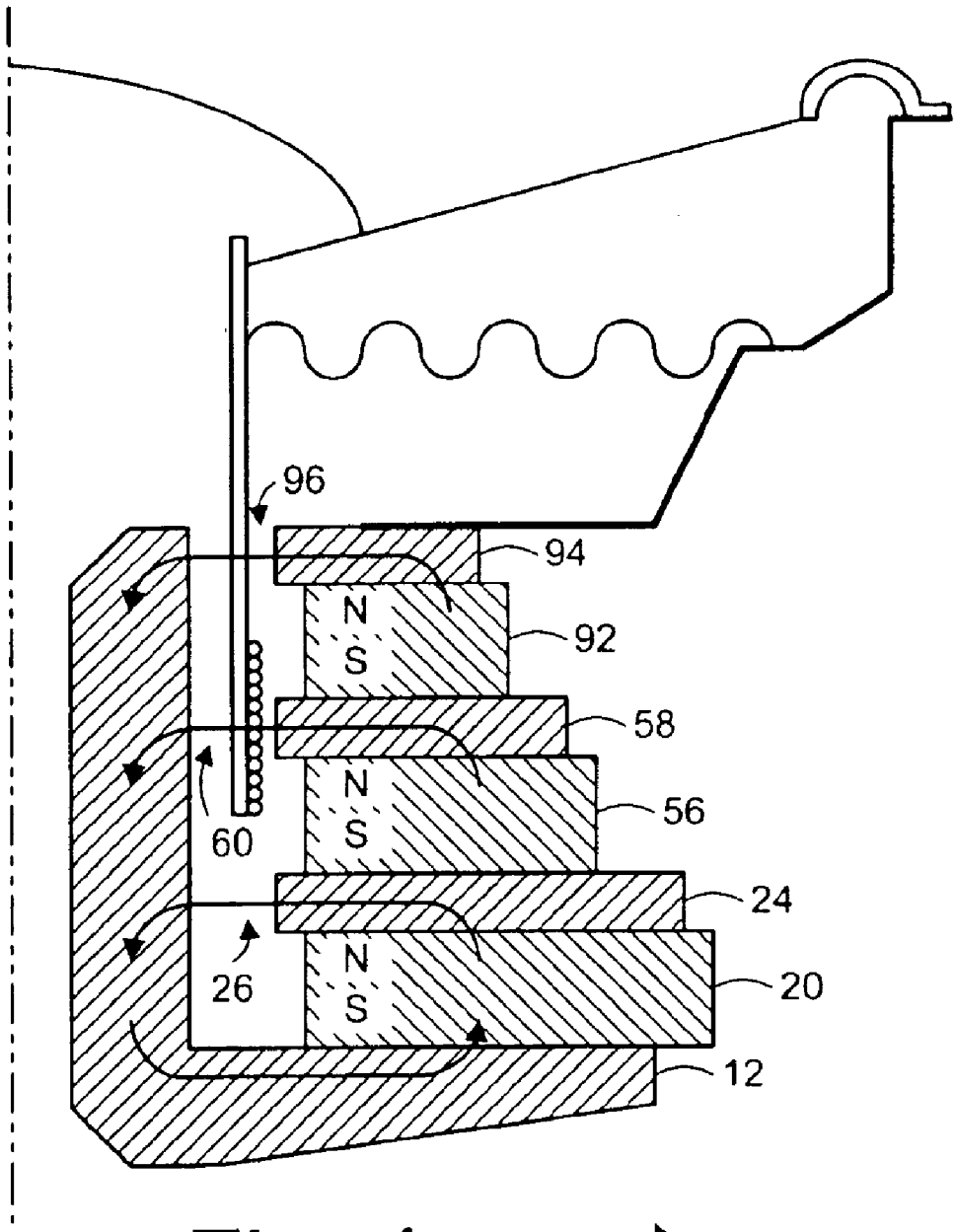
FIG. 4 shows, in cross-section, a third embodiment of a speaker geometry, having three air gaps and one voice coil.

FIG. 4 illustrates a third embodiment of a speaker geometry 90 according to this invention. The speaker includes a pole plate 12, first magnet 20, first plate 24, magnetic material member 56, second plate 58, and other components generally similar to those of the first embodiment. The speaker further includes a top magnetic material member 92 and a third plate 94 to define a third magnetic air gap 96. By including three or more air gaps, the total linear excursion of the voice coil can be made very large. By utilizing plates of the same thickness, and magnets of the same thickness (which may or may not be the same as the thickness of the plates, if a single voice coil is used), and by appropriately sizing the diameters of the magnets and plates, the flux density can be made substantially equal over each of the gaps, which results in optimum linearity over the entire range of linear voice coil travel. Selection of the particular thicknesses and diameters is well within the ordinary skill of those in this field armed with the previous discussion, and need not be discussed in detail here.

FIGS. 5A–F illustrate a fourth embodiment of a speaker geometry 100 which is similar to that of FIG. 4. The speaker includes pole plate 12, primary magnet 20, first gap plate 24, magnetic material member 56, second gap plate 58, magnetic material member 92, third gap plate 94, and bobbin 30, as well as the rest of the diaphragm assembly (not shown). The speaker further includes a voice coil 102 which extends from the center of the top magnetic air gap to the center of the bottom magnetic air gap, as shown. The speaker may optionally include a magnetically conductive spacer 104, if the primary magnet is not sufficiently thick to allow clearance for full voice coil travel.

Figure 5A:
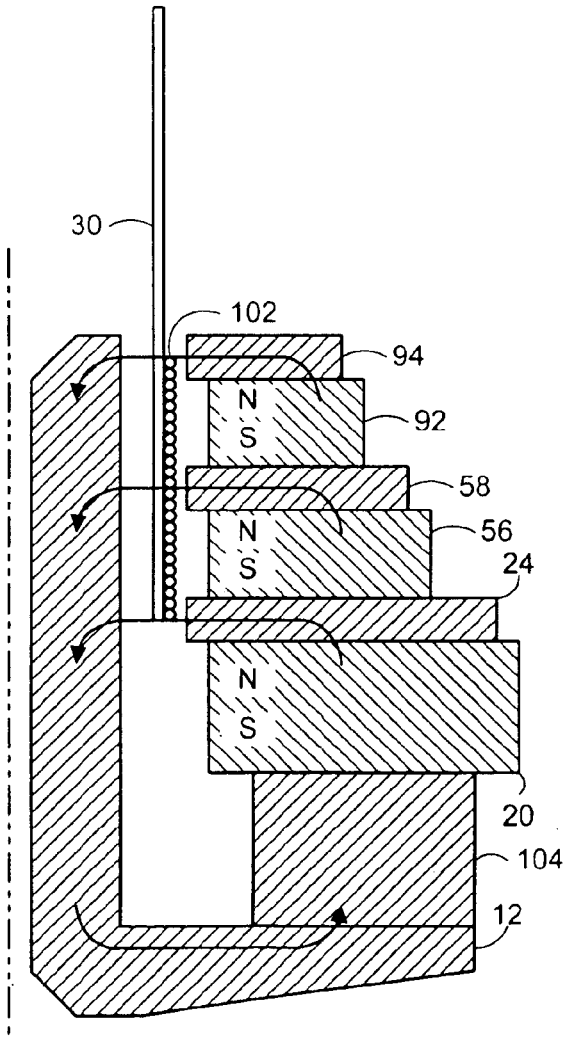
FIGS. 5A–F show, in cross-section, a fourth embodiment of a speaker geometry, having three air gaps and a single voice coil.
Figure 5B:
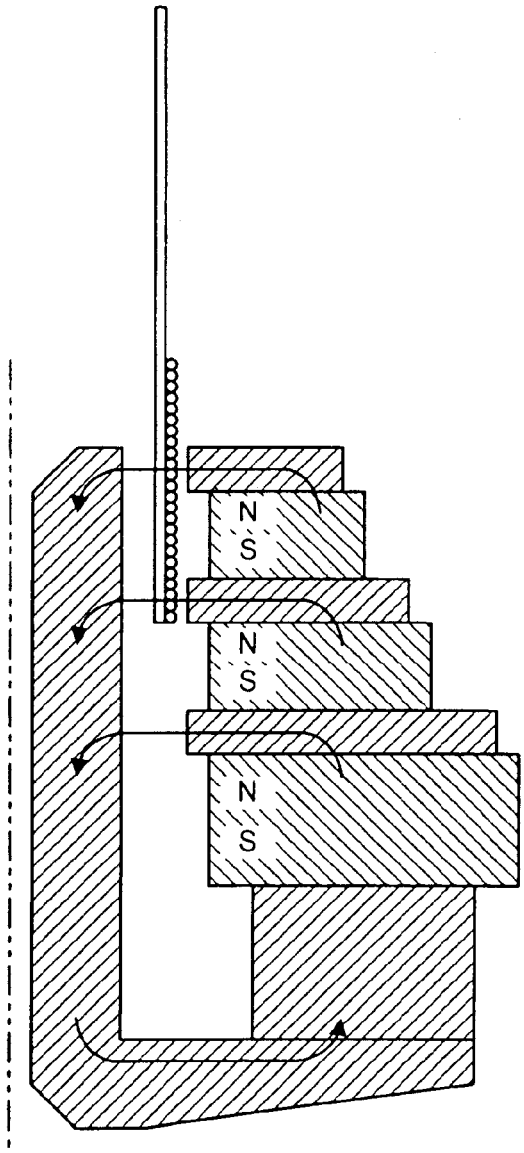
Figure 5C:
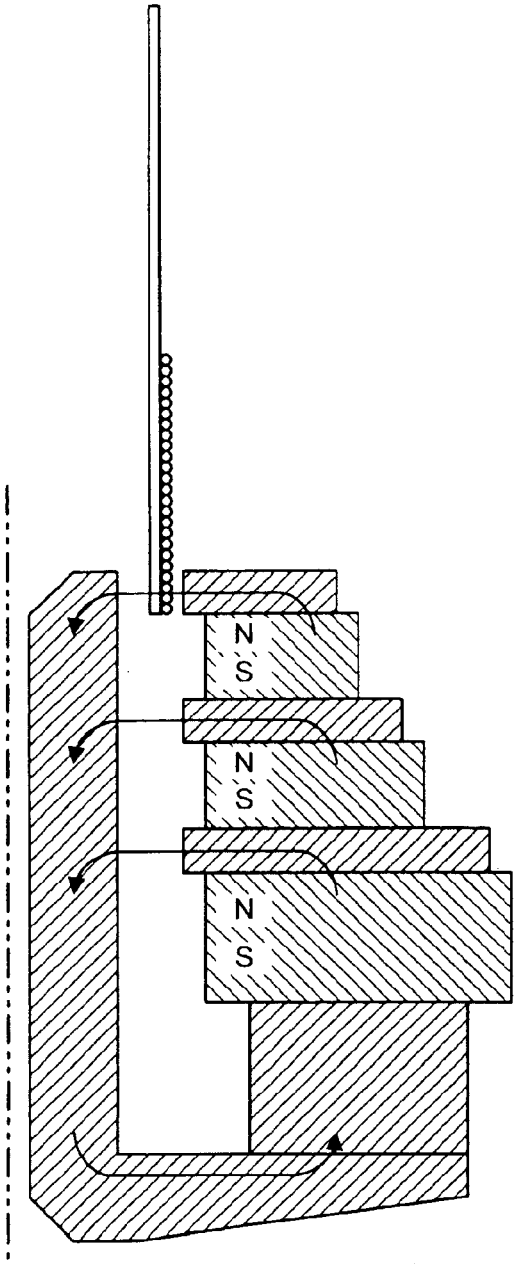
Figure 5D:
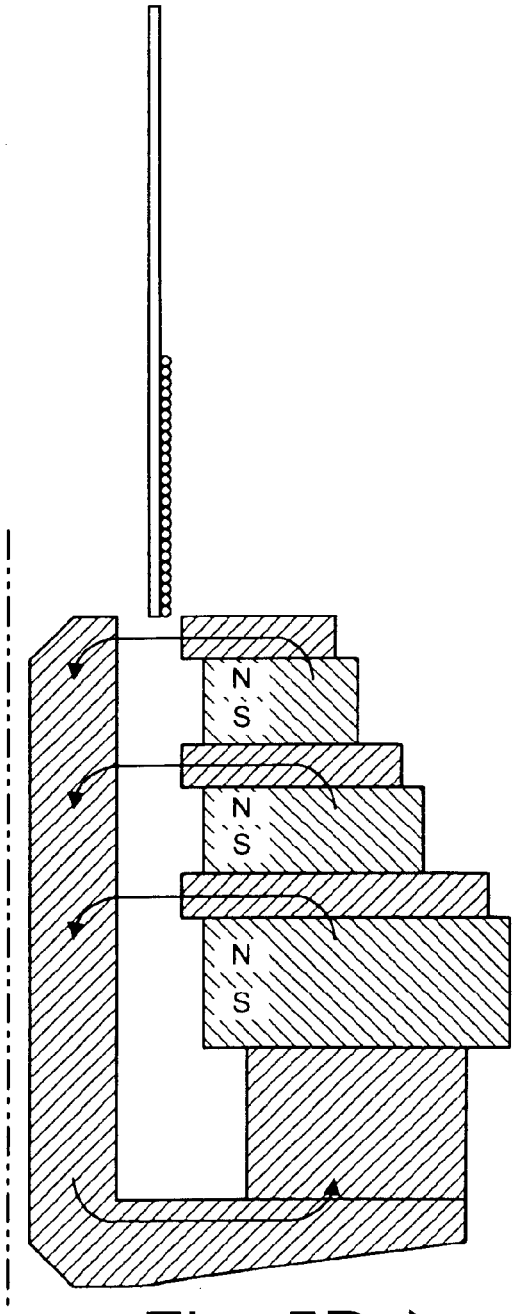

This configuration has the equivalent of two magnetic air gaps—66% of the total—active over the entire linear excursion. In FIG. 5A, the middle magnetic air gap is active, and one half of each of the top and bottom magnetic air gaps are active. FIG. 5B illustrates the diaphragm assembly at its most extended linear excursion position, in which the bottom of the voice coil is even with the bottom of the middle magnetic air gap; the top and middle magnetic air gaps are active, and the bottom magnetic air gap is inactive.

As the voice coil continues to extend outward, the middle magnetic air gap progressively becomes inactive. However, because the top magnetic air gap is still active, the speaker does not immediately exhibit high distortion. Instead, one full magnetic air gap (the top one) remains fully active until the position shown in FIG. 5C, where the bottom of the voice coil encounters the bottom of the top magnetic air gap. Only after that point, as the voice coil continues extending outward, does the electro-motive drive of the speaker trail off toward zero, at the point shown in FIG. 5D, where the bottom of the voice coil has left the top edge of the top magnetic air gap.

Figure 5E:
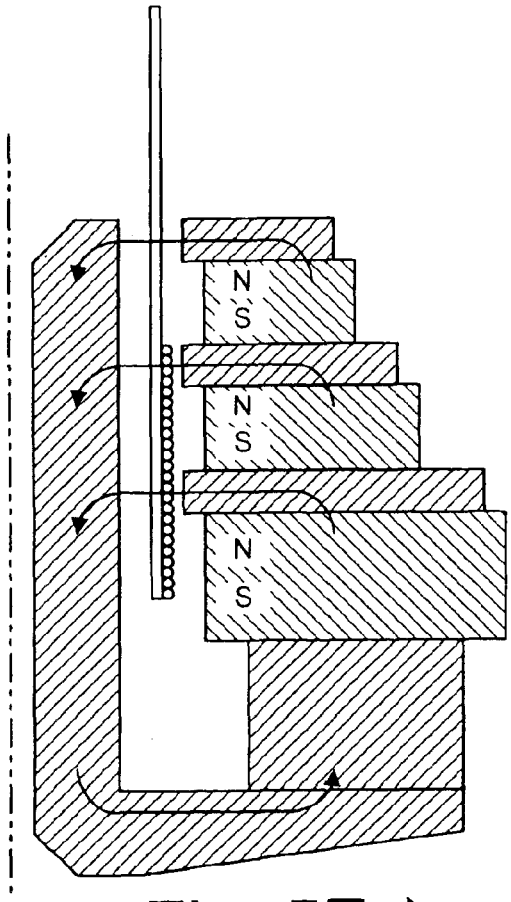
Figure 5F:
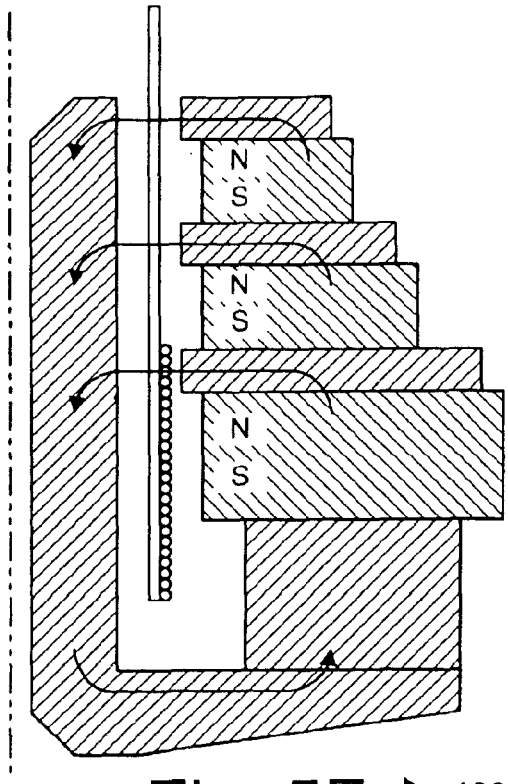

Going in the other direction from the centered position of FIG. 5A, FIG. 5E illustrates the other end of the linear excursion, where the top of the voice coil encounters the top of the middle magnetic air gap. Then, as the voice coil continues withdrawing, the middle magnetic air gap progressively becomes inactive, but the bottom magnetic air gap remains fully active until the position shown in FIG. 5F, where the top of the voice coil encounters the top of the bottom magnetic air gap. As the voice coil then continues withdrawing, the speaker electromotive drive will approach zero when the voice coil completely leaves the bottom magnetic air gap. FIG. 5F clearly demonstrates the purpose of the spacer between the bottom magnet and the pole plate, which is to provide enough space between the bottom magnetic air gap and the pole plate such that the voice coil and bobbin do not strike the pole plate.

This geometry provides good sound quality over an extended dynamic range, due to its stepped function in which there are, in effect, two levels of linear excursion: a center travel region in which two magnetic air gaps are active, and an outer region on either end of this center region, in which one magnetic air gap is active.

Figure 6:
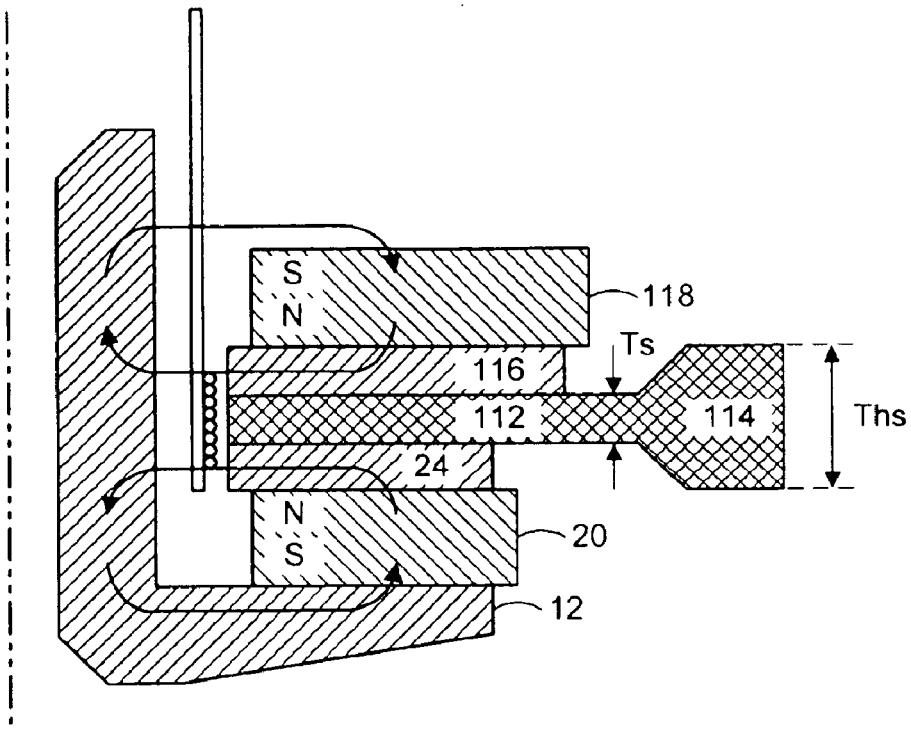
FIG. 6 shows, in cross-section, a fifth embodiment of a speaker geometry, having a cooling device built into the magnet assembly, with two air gaps and one voice coil.

FIG. 6 illustrates a fifth embodiment of a speaker geometry 110 according to this invention. The speaker includes a pole plate 12, first magnet 20, first plate 24, and diaphragm assembly as in the first embodiment. The speaker further includes a heatsink plate 112 which is made of a non-magnetically conductive and, ideally, highly thermally conductive, material such as aluminum. The heatsink plate may advantageously be equipped with a thermal dissipator portion 114 which, in some embodiments, may have a thickness Ths which is substantially greater than the thickness Tsp of the central portion of the heatsink plate. In such embodiments, the overall diameter of the heatsink plate should be sufficiently greater than those of the surrounding components to allow adequate clearance for the thicker heatsink perimeter. Although not illustrated in this cross-section, the heatsink may include axial or radial slots or fins to increase surface area and improve thermal transfer.

The speaker further includes a second plate 16 and a second permanent magnet 118. In this configuration, the second magnet is oriented opposite to the first magnet, so the magnetic flux across the two air gaps is in the same direction, enabling the use of a single voice coil or multiple voice coils generating the same electromagnetic polarity.

Figure 7:
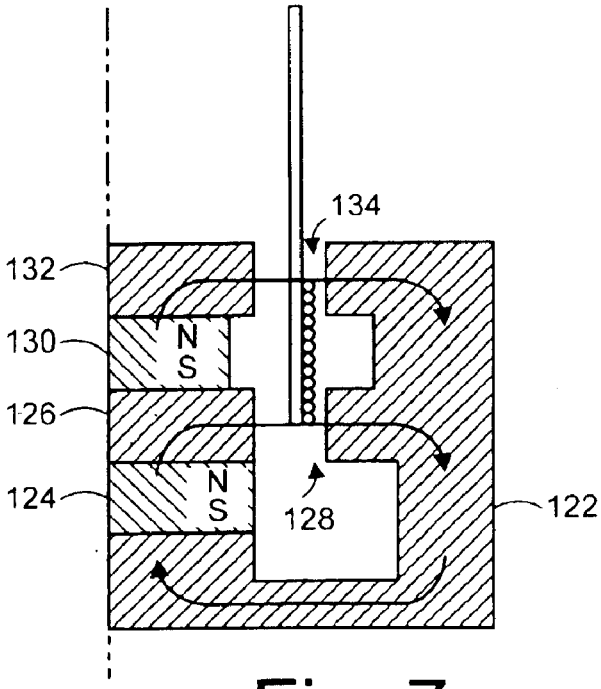
FIG. 7 shows, in cross-section, a sixth embodiment of a speaker geometry, using internal magnets, two air gaps, and one voice coil.

FIG. 7 illustrates a sixth embodiment of a speaker geometry 120 which utilizes internal magnets and plates rather than external ring magnets and plates. Typically, this is the geometry that is employed with neodymium-iron-boron magnets or other rare earth magnets. In this embodiment, the magnetic return path is via an outer perimeter of a yoke or cup 122 rather than via a pole piece. Within the cup are housed an internal magnet 124, a first plate 126 which defines a first magnetic air gap 128, a magnetic material member 130 which may be a permanent magnet or merely a ferrous spacer, and a second plate 132 which defines a second magnetic air gap 134. The bobbin may be equipped with one or more voice coils generating the same polarity and sized as indicated above. In the optimum case, the magnet or spacer 130 may be sized (in diameter) such that the magnetic flux over the top magnetic air gap is substantially the same as the magnetic flux over the bottom magnetic air gap. In some embodiments, the magnet or spacer 130 may be ring shaped. In some embodiments, the top magnet is the same diameter as the bottom magnet, but is made of weaker magnetic material.

In some embodiments, holes (not shown) may be provided through the cup and/or plates and/or magnets to provide air flow to both cool and depressurize the assembly when the voice coil and diaphragm are in heavy movement. In some embodiments, this may be accomplished with one central hole, in an internal ring magnet configuration.

Figure 8:
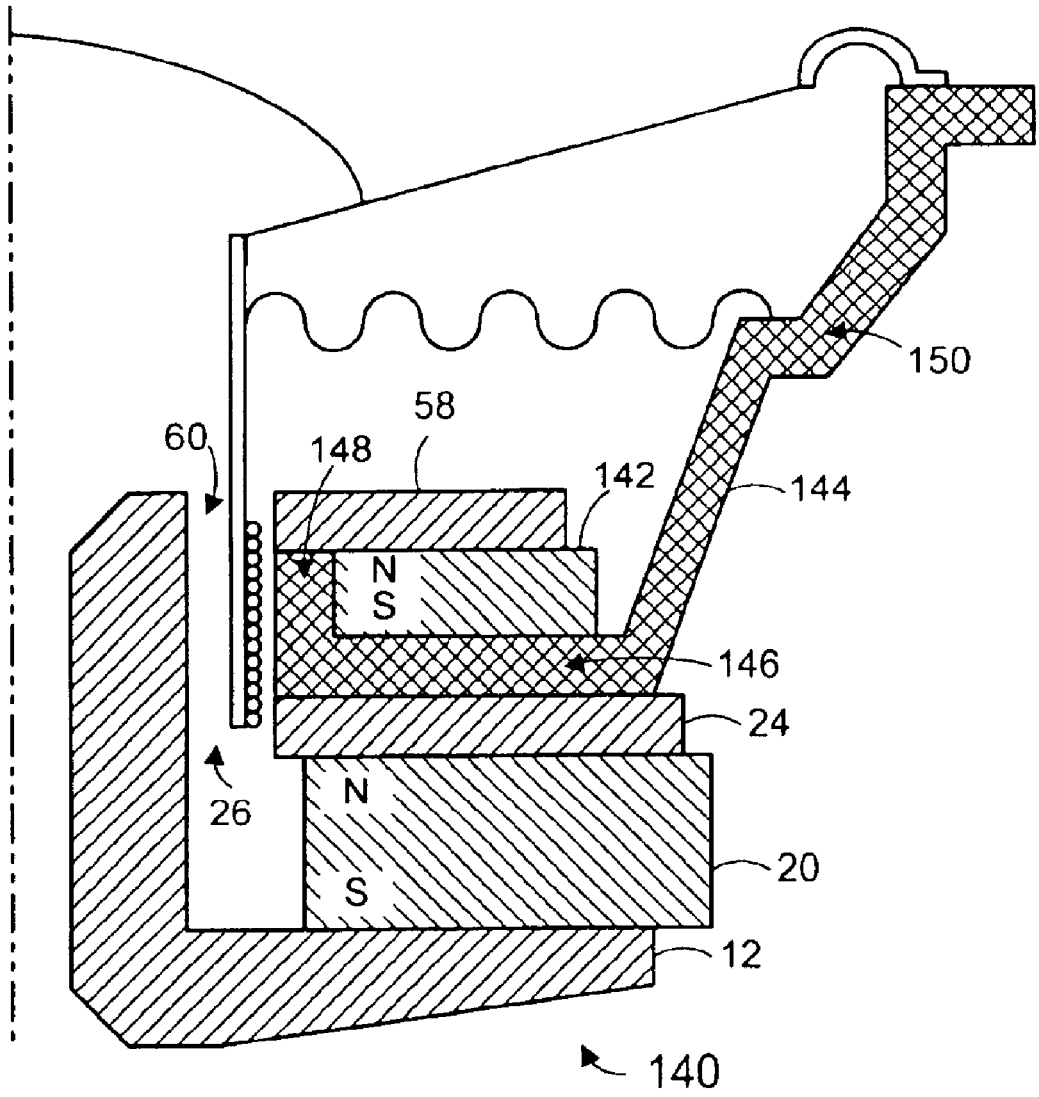
FIG. 8 shows, in cross-section, a seventh embodiment of a speaker geometry, with a unified frame and heatsink.

FIG. 8 illustrates a seventh embodiment of the invention, which is similar to those of FIGS. 2 and 6. The speaker 140 includes a pole plate 12, primary magnet 20, first magnetic air gap plate 24, and second magnetic air gap plate 58, as before. The top magnet 142 has an enlarged inner diameter to accommodate a combined frame and heatsink 144. The heatsink-frame 144 is made of a non-magnetically conductive material, such as aluminum, and includes a portion 146 which is disposed between the first plate and the top magnet, a portion 148 which is disposed within the enlarged inner diameter of the upper magnetic material member such that an enlarged surface area of the heatsink is exposed to the section of the voice coil spanning between the air gaps, and a portion 150 which serves as the frame to support the diaphragm assembly. In some embodiments, the inner surface of the heatsink portion 148 is substantially aligned with, or slightly recessed from, the inner diameters of the two plates.

Figure 9:
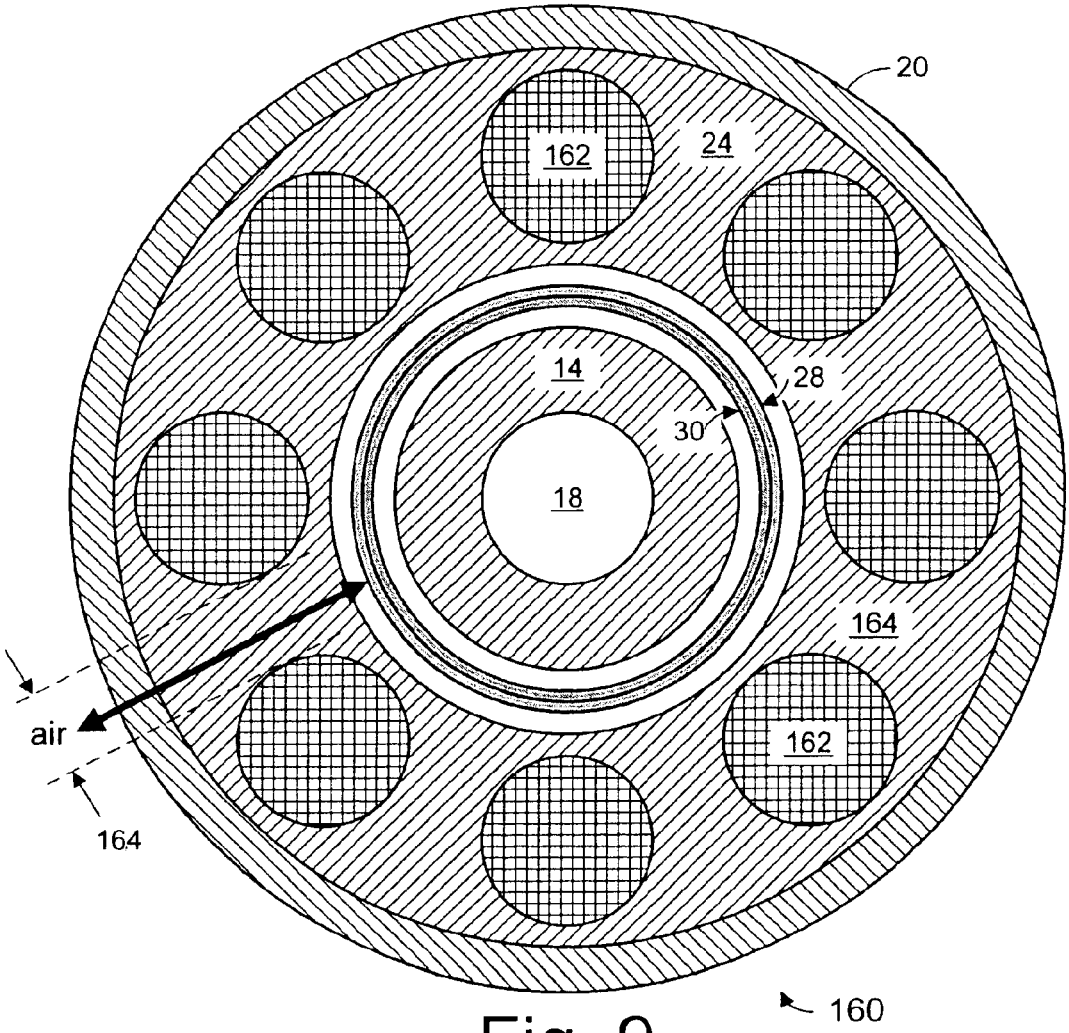
FIG. 9 shows, in top view, an eighth embodiment of a speaker geometry, in which the upper magnet is comprised of a plurality of smaller magnets having spaces between them to permit airflow to cool the voice coil.

FIG. 9 illustrates an alternative embodiment which may optionally be practiced in combination with other principles taught herein. Portions of a motor assembly 160 are shown in top view. From the top, the pole piece 14 is visible, with its optional air vent hole 18. The bobbin 30 and voice coil 28 are seen in cross-section when viewed from above. The bottom, primary magnet 20 is visible and disposed about the pole piece. The first plate 24 is disposed about the pole piece, and is magnetically coupled to the bottom magnet. The second plate is not shown, so that the reader can see the multiple top magnetic material members 162 which are disposed about the axis of the motor. Spaces 164 exist between adjacent top magnetic material members, to permit airflow in and out of the motor structure, to improve cooling. In some embodiments, the motor structure may include a screen or mesh (not shown) to prevent foreign particles from entering into the motor through the spaces between the top magnets. The top magnets 162 have their magnetic poles aligned such that e.g. their North poles are facing out of the page. The skilled reader will appreciate that the top magnets are not necessarily of a round disc shape, and that other shapes, with or without holes, will offer different advantages. For example, a set of wedge-shaped top magnets will offer increased surface area and increased magnetic flux across the top magnetic air gap (not shown).

The total linear excursion in single voice coil embodiments of a speaker according to the principles taught in this patent is substantially equal to:

$$((NG-K+1)*HS)+((NS-K+1)*HG)$$

where K is the number of magnetic air gaps which the voice coil can have active at a time, NG is the number of magnetic air gaps, NS is the number of spaces between the magnetic air gaps (or, in other words, NG−1), HG is the height of a magnetic air gap, and HS is the height of the space between adjacent magnetic air gaps, as long as K is less than NG.

Figure 10:
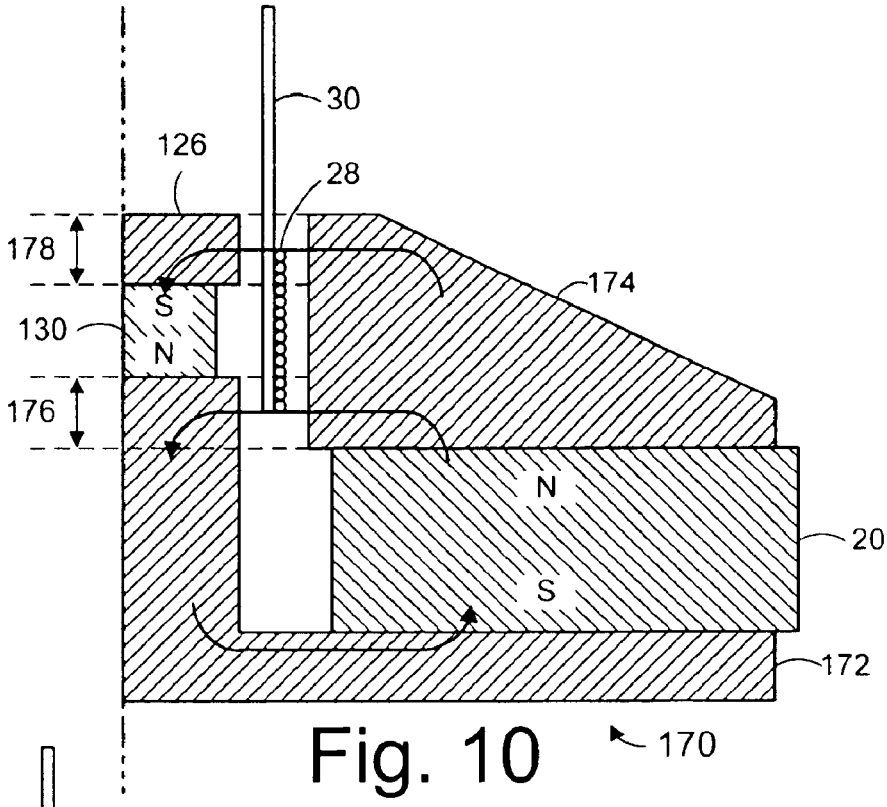
FIG. 10 shows, in cross-section, a ninth embodiment of a speaker geometry using a combination of an external ring magnet as the primary magnet and an internal disc magnet for the upper magnetic air gap.

FIG. 10 illustrates a ninth embodiment of a dual-gap speaker 170 using a hybrid geometry. The speaker includes a pole plate 172 and a primary magnet 20 which is an external ring magnet. An annular external top plate 174 is magnetically coupled to the primary magnet and defines a bottom magnetic air gap 176 between the annular external top plate and the pole piece of the pole plate. An internal top magnet 130, which may be a disc magnet, is magnetically coupled to the top of the pole piece, and has its magnetic poles oriented opposite those of the primary magnet with respect to the axis of the speaker. An internal top plate 126 is magnetically coupled to the internal top magnet. The top magnetic air gap 178 is defined between the annular external top plate and the internal top plate. Magnetic flux over the two magnetic air gaps is in the same direction with respect to the pole piece or magnetic return path member. A voice coil 28 and bobbin 30 assembly rides in the magnetic air gaps.

Figure 11:
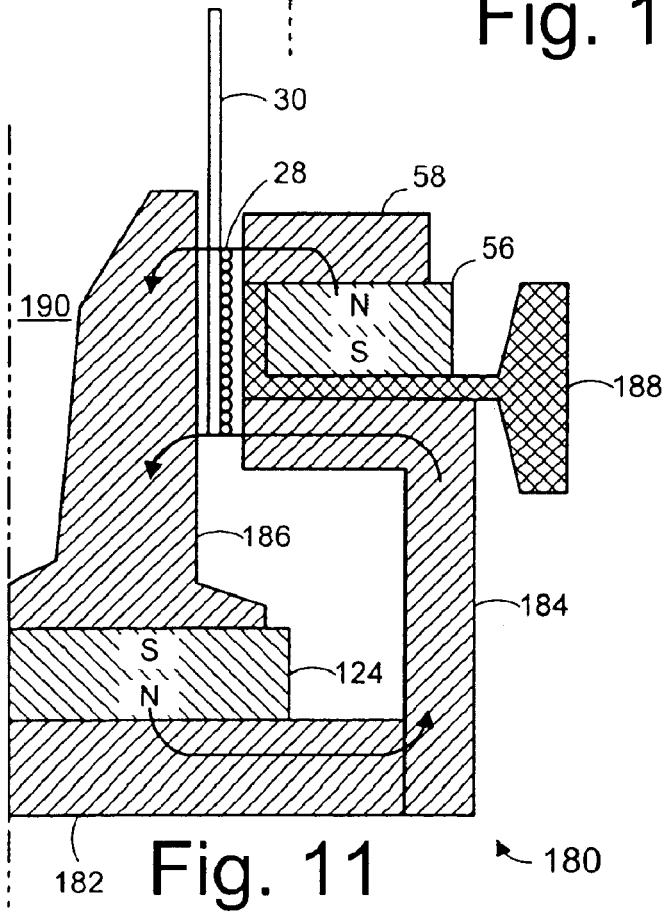
FIG. 11 shows, in cross-section, a tenth embodiment of a speaker geometry using an internal disc magnet as the primary magnet and an external ring magnet for the upper magnetic air gap.

FIG. 11 illustrates a tenth embodiment of a dual-gap speaker 180 using a different hybrid geometry. The speaker includes a cup which may include a back plate 182 and a side wall member 184, or it can be a monolithic structure. An internal magnet 124, which may be a disc magnet, is the primary magnet and is magnetically coupled to the cup. An extended internal top plate member 186, which may alternatively be considered as a pole piece, is magnetically coupled to the primary magnet. An external ring top magnet 56 is magnetically coupled to the cup, optionally over a non-magnetically conductive heatsink 188, and has its magnetic poles oriented opposite those of the primary internal magnet, with respect to the axis of the speaker. An external top plate 58 is magnetically coupled to the external top magnet. The pole piece 186 defines a bottom magnetic air gap between itself and the cup, and a top magnetic air gap between itself and the external top plate. Optionally, the pole piece may be adapted with a hole 190 for reducing its weight and improving cooling of the motor structure. In some embodiments, the hole can extend through the pole piece, the internal primary magnet (which is, then, a ring magnet), and the cup. A voice coil 28 and bobbin 30 assembly rides in the magnetic air gaps.

CONCLUSION

Reference in the specification to "an embodiment," "one embodiment," "some embodiments," or "other embodiments" means that a particular feature, structure, or characteristic described in connection with the embodiments is included in at least some embodiments, but not necessarily all embodiments, of the invention. The various appearances "an embodiment," "one embodiment," or "some embodiments" are not necessarily all referring to the same embodiments.

If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

In the claims, the phrase "magnetically coupled to" is intended to mean "in magnetic communication with" or in other words "in a magnetic flux circuit with", and not "mechanically affixed to by means of magnetic attraction." In the claims, the phrase "air gap" is intended to mean "gap over which magnetic flux is concentrated" and not limited to the case where such gap is actually filled with air; the gap could, in some applications, be filled with any suitable gas or liquid such as magnetic fluid, or even be under vacuum.

When one component is said to be "adjacent" another component, it should not be interpreted to mean that there is absolutely nothing between the two components, only that they are in the order indicated.

The several features illustrated in the various figures may be combined in many ways, and should not be interpreted as though limited to the specific embodiments in which they were explained and shown.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. An electromagnetic transducer comprising:

a yoke having an axis;

a first permanent magnet magnetically coupled to the yoke and having a polarization in a first orientation with respect to the axis;

a first plate magnetically coupled to the first permanent magnet opposite the yoke and defining a first magnetic air gap between the first plate and the yoke, wherein magnetic flux over the first magnetic air gap is in a first direction with respect to the yoke;

a second permanent magnet magnetically coupled to the first plate opposite the first permanent magnet and having a polarization in the same first orientation with respect to the axis; and a second plate magnetically coupled to the second permanent magnet opposite the first plate and defining a second magnetic air gap between the second plate and the yoke, wherein magnetic flux over the second magnetic air gap is in the first direction with respect to the yoke.

2. The electromagnetic transducer of claim 1 further comprising:

a voice coil having a length substantially equal to a distance from a center of the first magnetic air gap to a center of the second magnetic air gap.

3. The electromagnetic transducer of claim 1 further comprising:

a third permanent magnet magnetically coupled to the second plate opposite the second permanent magnet and having a polarization in the same first orientation with respect to the axis; and a third plate magnetically coupled to the third permanent magnet opposite the second plate and defining a third magnetic air gap between the third plate and the yoke, wherein magnetic flux over the third magnetic air gap is in the first direction with respect to the yoke.

4. The electromagnetic transducer of claim 3 further comprising:

a voice coil having a length substantially equal to a distance from a center of the first magnetic air gap to a center of the third magnetic air gap.

5. The electromagnetic transducer of claim 1 further comprising:

a non magnetically conductive heatsink coupled between the first and second plates.

6. The electromagnetic transducer of claim 5 wherein the heatsink comprises:

a portion extending beyond at least one of the first and second plates and including at least one of, a thicker cross-section than a portion which is between the first and second plates, holes, slots, and fins.

7. The electromagnetic transducer of claim 6 wherein the heatsink comprises:

a first portion extending inward substantially to one of the first and second magnetic air gaps; and a second portion extending outward to form a frame of the electromagnetic transducer.

8. The electromagnetic transducer of claim 7 wherein the heatsink further comprises:

a third portion extending axially;

wherein the second magnet has an inner diameter permitting it to fit around the third portion of the heatsink.

9. The electromagnetic transducer of claim 7 further comprising:

a diaphragm coupled to the frame;

a bobbin coupled to the diaphragm; and a voice coil coupled to the bobbin and extending at least partially into one of the magnetic air gaps.

10. The electromagnetic transducer of claim 1 wherein:

the yoke comprises a cup; and the electromagnetic transducer has an internal magnet geometry.

11. The electromagnetic transducer of claim 1 wherein:

the yoke comprises a pole plate; and the electromagnetic transducer has an external magnet geometry.

12. The electromagnetic transducer of claim 1 wherein magnetic flux over the first magnetic air gap is less than 10% different than magnetic flux over the second magnetic air gap.

13. The electromagnetic transducer of claim 1 wherein magnetic flux over the first magnetic air gap is less than 1% different than magnetic flux over the second magnetic air gap.

14. The electromagnetic transducer of claim 1 configured to operate as a speaker.

15. The electromagnetic transducer of claim 1 configured to operate as a microphone.

16. The electromagnetic transducer of claim 1 configured to operate as a position sensor.

17. The electromagnetic transducer of claim 1 configured to operate as an actuator.

18. An electromagnetic transducer comprising:

a plurality of magnetic air gaps between a magnet-and-plate assembly and a yoke, the magnet-and-plate assembly including a first permanent magnet magnetically coupled to the yoke, a first magnetically conductive plate magnetically coupled to the first permanent magnet, a second permanent magnet magnetically coupled to the first plate, and a second magnetically conductive plate magnetically coupled to the second permanent magnet, opposite the first plate;

magnetic flux across each of the respective air gaps being oriented in a same direction with respect to the yoke; and a voice coil assembly moveably disposed within at least one of the air gaps.

19. The electromagnetic transducer of claim 18 wherein the yoke comprises:

a pole plate including, a back plate to which the first permanent magnet is magnetically coupled, and a pole piece about which the magnet-and-plate assembly is disposed.

20. The electromagnetic transducer of claim 18 wherein the yoke comprises a cup within which the magnet-and-plate assembly is disposed.

21. The electromagnetic transducer of claim 18 further comprising:

a frame; and a diaphragm coupled to the voice coil assembly and the frame.

22. The electromagnetic transducer of claim 18 wherein the second magnet comprises:

a plurality of second magnets distributed about an axis of the yoke.

23. The electromagnetic transducer of claim 22 wherein:

each of the plurality of second magnets has a substantially circular shape.

24. The electromagnetic transducer of claim 22 wherein:

each of the plurality of second magnets has a substantially wedge shape.

25. The electromagnetic transducer of claim 22 further comprising:

an airflow space between adjacent pairs of the plurality of second magnets.

26. The electromagnetic transducer of claim 18 wherein:

the second magnet has a smaller surface area than does the first magnet.

27. An audio speaker comprising:

a frame;

a diaphragm assembly coupled to the frame and including a voice coil;

a motor structure coupled to the frame and including, a magnetically conductive yoke, a first permanent magnet magnetically coupled to the yoke and polarized in a first orientation with respect to the yoke, a first plate magnetically coupled to the first permanent magnet and defining a first magnetic air gap with the yoke, a second permanent magnet magnetically coupled to the first plate opposite the first permanent magnet and polarized in the first orientation with respect to the yoke, and a second plate magnetically coupled to the second magnet opposite the first plate and defining a second magnetic air gap with the yoke, wherein magnetic flux travels in a same direction over the first and second magnetic air gaps, and wherein the voice coil is disposed within at least one of the magnetic air gaps.

28. The audio speaker of claim 27 wherein:

the voice coil has a height substantially equal to a thickness of the second magnet plus half a thickness of the first plate plus half a thickness of the second plate.

29. The audio speaker of claim 28 wherein:

when the audio speaker is at rest, the voice coil is substantially centered about the second magnet.

30. The audio speaker of claim 27 wherein:

the frame includes a non magnetically conductive heatsink which extends between the second magnet and one of the first and second plates.

31. The audio speaker of claim 30 wherein:

the heatsink includes an axially extending shorting ring which fits within an inner diameter of the second magnet.

* * * * *